United States Patent [19]

Danke

[11] 3,983,568

[45] Sept. 28, 1976

[54] TIME RECORDER HAVING WHEEL ALIGNMENT MEANS

[75] Inventor: Rudolph B. Danke, Petersham, Mass.

[73] Assignee: Simplex Time Recorder Company, Gardner, Mass.

[22] Filed: Apr. 10, 1975

[21] Appl. No.: 566,802

Related U.S. Application Data

[62] Division of Ser. No. 436,148, Jan. 24, 1974, Pat. No. 3,890,624, which is a division of Ser. No. 236,358, March 20, 1972, Pat. No. 3,800,301.

[52] U.S. Cl. ..... 346/91

[51] Int. Cl.[2] ..... G07C 1/06

[58] Field of Search ..... 346/91, 87, 84, 82, 346/83, 145

[56] References Cited

UNITED STATES PATENTS

| | | | |
|---|---|---|---|
| 900,059 | 9/1908 | Doremus | 346/91 X |
| 908,971 | 1/1909 | Dey et al. | 346/84 X |
| 1,262,703 | 4/1919 | Ross | 346/91 X |
| 1,469,988 | 10/1923 | Bryce et al. | 346/145 |

*Primary Examiner*—Joseph W. Hartary
*Attorney, Agent, or Firm*—Norman S. Blodgett; Gerry A. Blodgett

[57] ABSTRACT

A time recorder for recording elapsed time, including a time stamp with means for bringing the closer character of the least increment wheel into alignment with the characters on the other wheels.

3 Claims, 17 Drawing Figures

TIME RECORDER HAVING WHEEL ALIGNMENT MEANS

This is a division of application Ser. No. 436,148 filed Jan. 24, 1974, now U.S. Pat. No. 3,890,624, which in turn is a division of application Ser. No. 236,358 filed Mar. 20, 1972, now U.S. Pat. No. 3,800,301.

BACKGROUND OF THE INVENTION

There are many situations in the business world where it is desirable to record both a beginning time and a finishing time for an event for eventual conversion to a figure indicative of elapsed time. Such a situation exists in the case of the timing of long distance telephone calls. For this purpose, the telephone operator is provided with a time recorder having a slot into which she inserts a card for each long distance telephone call made. She inserts the card and presses an actuator so that the starting time is printed on the card. After the telephone call is over, she again inserts the same card and presses the same handle to record the time again. A time interval is shown, this often being accomplished on a dial which is printed on the card. Since the operator has limited space on her console, it is desirable that this time recorder be quite thin and that it be adapted for flush mounting. In addition, modern business methods have led to optical scanning of such cards for the purpose of computing bills. In the past, time recorders have suffered from a number of disabilities that prevent this type of operation from being entirely successful. For one thing, the limited space available in thin time recorders has resulted in a printed character that is not clear and distinct. Furthermore, under certain conditions, the time printing wheels, particularly those which are faster moving (such as the 1/10th of a minute wheel) often rotate to positions between characters, so that no character is printed, and the optical scanner is unable to find a character to record. Attempts to move such a wheel incrementally to assure that one character or another is properly centered at the moment of printing has not only resulted in gain and loss of time in the total recording of the time stamp, but also has resulted in worn pawls and ratchets for accomplishing this purpose. These and other difficulties experienced with the prior art devices have been obviated in a novel manner by the present invention.

It is, therefore, an outstanding object of the invention to provide a time recorder which, although small in size, is capable of giving a clear printed character.

Another object of this invention is the provision of a time recorder in which the fastest moving time wheel is driven continuously to avoid the use of pawl and ratchets, but which, nevertheless, centers each character adequately.

A further object of the present invention is the provision of a time recorder capable of giving a printed image particularly adaptable to optical scanning.

It is another object of the instant invention to provide a time recorder in which one of the time stamp wheels is continuously driven, in which, at the time of printing, the nearest character is brought into a predetermined line, and in which, after printing, is returned to the position at which it would have resided if printing had not taken place.

A still further object of the invention is the provision of a time recorder having time print wheels operated by pawls, in which the wheels are securely locked against movement except at the moment when a pawl engages a wheel, and in which the unlocking mechanism is not capable of accidentally moving into a condition where all of the wheels remain unlocked.

It is a further object of the invention to provide a time stamp of the pawl-and-ratchet type which is provided with a locking means which is very unlikely to accidentally catch in unlocked condition.

It is a still further object of the invention to provide a time recorder whose elements are readily accessible for inspection and repair.

Another object of the invention is the provision of a time recorder of simple and rugged construction which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a time recorder having a housing with a slot into which a time card can be inserted, having a time stamp located in the housing at one side of the plane of the slot, and having an inking ribbon lying adjacent the time stamp. A striking hammer is located on the other side of the plane of the slot. Means is provided associated with the hammer to store energy and release it suddenly to move the hammer toward a card lying in the slot and driving it against the ribbon and the time stamp.

More specifically, the time stamp is provided with means for driving its fastest moving wheel continuously and yet providing for lining up a character when the energy is suddenly released and returning the wheel to its original position before that time. The time stamp is provided with a locking bar to prevent movement of most of the time wheels except when a pawl engages a ratchet, the mechanism being provided to release the locking bar at that time and returning it to locking position after the ratchet has moved a wheel.

The housing is built in two parts that are hingedly related for ready access to the interior. A slot is provided with two portions that lie in staggered relationship to permit successive stamping of the card at diffferent positions thereon.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
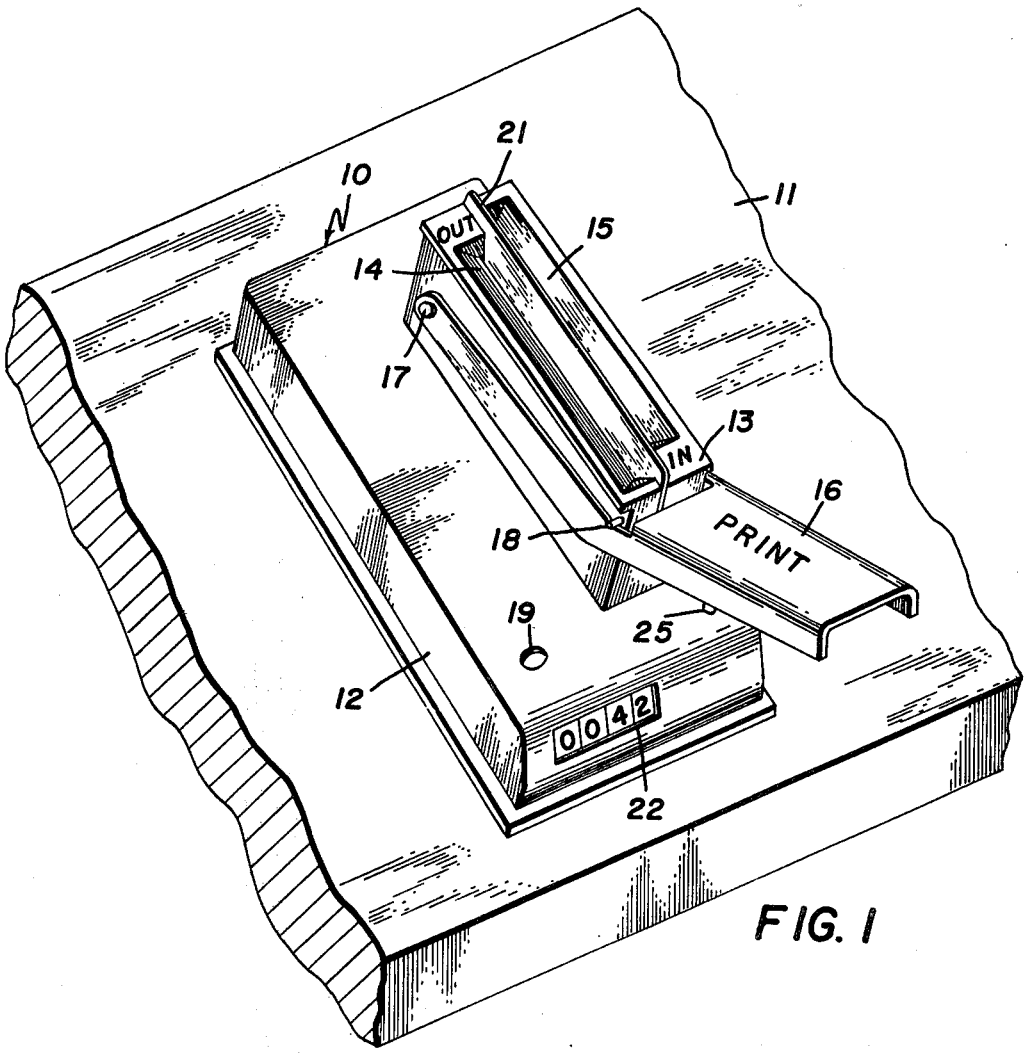
FIG. 1 is a perspective view of a time recorder embodying the principles of the present invention.

Referring first to FIG. 1, wherein are best shown the general features of the invention, the time recorder, indicated generally by the reference numeral 10, is shown in operative position on the deck 11 of a telephone operator's console. A sheet metal cover 12 covers most of the mechanism, but an entrance abutment 13 extends through the cover and is provided in its upper part with two slots 14 and 15 into which a time card can be inserted. An operating PRINT handle 16 is pivotally attached to the abutment 13 by means of a hinge pin 17 and normally rests against a stop pin 18 extending from the upper part of the abutment 13. The cover 12 is provided with an aperture 19 for a purpose to be explained more fully hereinafter. Between the slots 14 and 15 extends a divider wall 21, and the slots 15 and 14 are provided with the indicia "IN" and "OUT", respectively. The cover 12 is provided with a window 22 through which can be seen time elements forming part of the mechanism.

It should be noted that the surfaces of the slots 14 and 15 are slanted toward the divider wall 21 and that they are non-coextensive by a substantial amount in such a way that a time card inserted in one slot is displaced by that substantial amount from a time card placed in the other slot.

Figure 2:
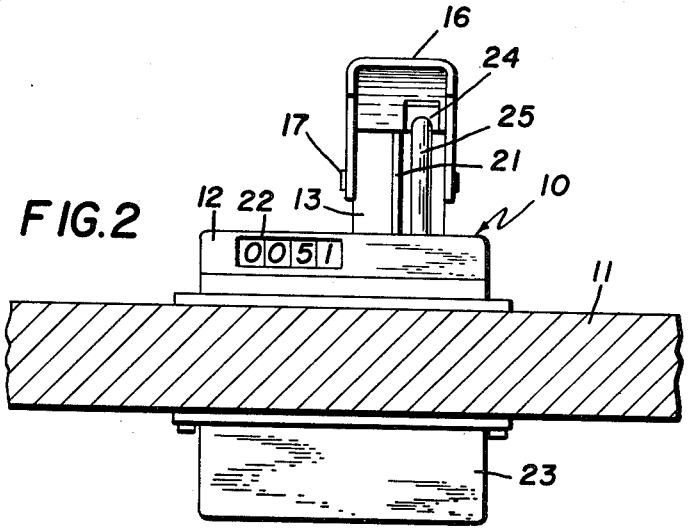
FIG. 2 is a front elevational view of the recorder.

In FIG. 2 it can be seen that the underside of the deck 11 is provided with a box-like sheet metal enclosure 23 into which portion of the time recorder extends. In this view, it can be seen that the underside of the handle 16 is provided with a plastic pad 24 which engages the top end of a vertical plunger 25 which is vertically slidable relative to the entrance abutment 13.

Figure 3:
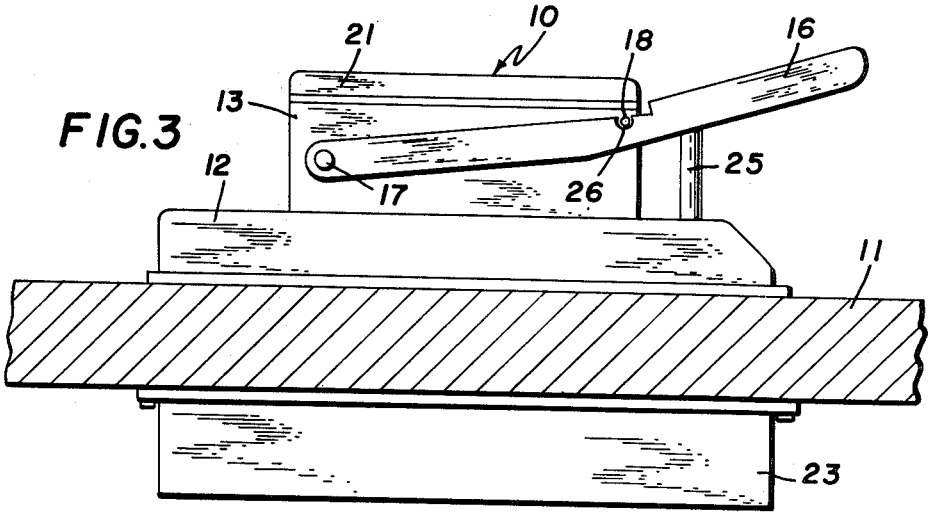
FIG. 3 is a side elevational view of the time recorder.

As is evident in FIG. 3, the plunger 25 is spaced forwardly of the entrance abutment 13 by a substantial amount. It can be seen that the stop pin 18 engages a small notch 26 formed on the upper edge of one of the legs of the handle 16.

Figure 4:
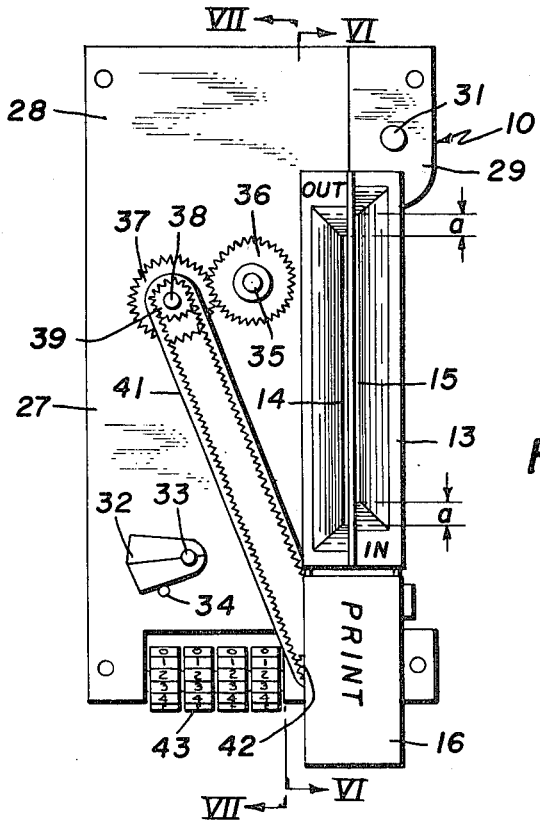
FIG. 4 is a plan view of the time recorder with a cover removed.

In FIG. 4 and subsequent figures of the drawings, the cover 12, the deck 11, and the enclosure 23 are all removed. In FIG. 4 the non-coextensive relationship of the slots 14 and 15 is very clearly shown. The substantial distance by which they are non-coextensive is indicated by the reference character "*a*" and, ultimately, this results in the time being printed on the time card along different spaced lines when the card is first inserted in the slot 15 and then inserted in the slot 14.

Generally speaking, the time recorder consists of a frame 27 divided into two portions, a time portion 28 and a stamp portion 29, the portions being hinged for vertical swinging motion about one end with the pivot being provided by a vertical shaft 31. On the upper surface of the time portion 28 is an indicator 32 which is keyed to a shaft 33 and is divided into a dark portion (preferably colored red) and a light portion (preferably colored white), these portions appearing through the aperture 19 of the cover 12 on occasion. A suitable stop pin 34 engages one side of the indicator on occasion. Extending from the top of the time portion 28 is a shaft 35 to which is keyed a gear 36. This gear engages another gear 37 mounting on a protruding end of a vertical shaft 38 which is parallel to and spaced from the shaft 35. Also keyed to the shaft 38 but at a different vertical level from the gear 37 is a small gear 39. This gear is connected by a timing belt 41 which also extends around a gear 42 mounted in the frame 27 and adapted to drive a series of time clock wheels 43 which are located so that they can be seen through the window 12 (see FIG. 1).

Figure 5:
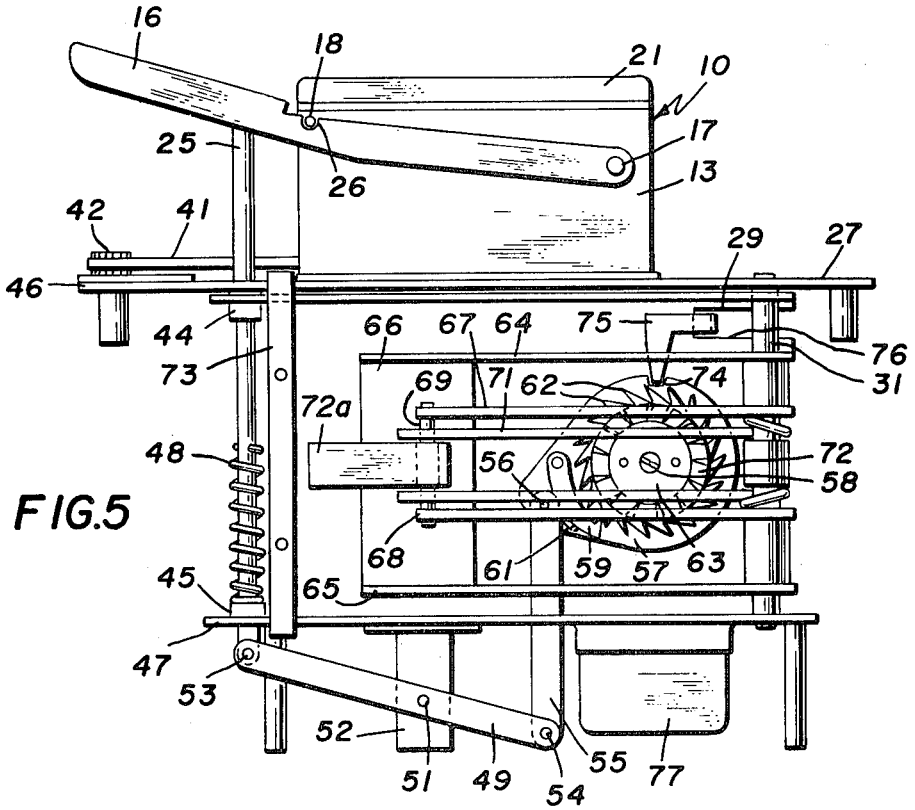
FIG. 5 is a side elevational view of a portion of the recorder.

FIG. 5 shows a side view of the stamp portion 29 with the time portion 28 removed. The plunger 25 is shown as being slidably mounted for vertical movement in bearings 44 and 45 carried in top and bottom plates 46 and 47, respectively of the frame. A coil spring 48 holds the plunger 25 in normally upwardly-biased condition and only by pressing downwardly on the handle 16 is it moved vertically downwardly. A lever 49 is swingably mounted on a pivot pin 51 carried on an extension 52 of the bottom plate 47. One end of the lever 49 is pivotally connected to the lower end of the plunger 25 by a hinge pin 53, while the other end is connected by a hinge pin 54 to a vertical bar 55. The upper end of the bar 55 is pivotally connected by a pin 56 to an extension of a plate 57 rotatably mounted on a horizontal shaft 58 mounted in the frame 27. Swingably carried on the plate 57 is a pawl 59 which is resiliently urged inwardly toward the shaft 58 by a spring 61. The pawl is thus urged into contact with a row of ratchet teeth 62 formed on the outer periphery of a rotatable element 63 rotatably mounted on the shaft 58 independently of the movement of the plate 57. A pair of parallel arms 64 and 65 are pivotally mounted at one end on the shaft 31 and at the other end secured to a hammer plate 66. Another pair of arms 67 and 68 are also pivotally mounted on the shaft 31 but, of course, spaced inwardly from the arms 64 and 65. The ends of the arms 67 and 68 not pivoted on the shaft 31 are joined by a bar 69. Pressing against this bar is a U-shaped spring 71, the legs of which are wrapped around the shaft 31 and secured thereto to act as a torsion spring. A leaf spring 72, which is of a generally U-shaped configuration when viewed from above, has one leg welded to the plate 66 and the other end free but overlying the bight of the spring 71 and resting against the bar 69. The legs 67 and 68 rest on an annular row 72 of cams which are integral with the element 63 rotatably mounted on the shaft 59, that is to say, these cams are integral and move with the ratchet teeth 62.

Mounted at the forward part of the stamp portion 29 of the frame is a latching bar 73 which serves to hold together the free ends of the hinged time portion 28 and stamp portion 29. The upper part of the plate 57 is provided with a notch 74 within which lies the tapered lower end of a finger 75. This finger is bent around through an opening 76 in a back wall of the stamp portion 29 and will be described more fully hereinafter. In this view can be seen an electric motor 77 hanging downwardly from the time portion 28 of the recorder as well as the timing belt 41 and the gear 42.

Figure 6:
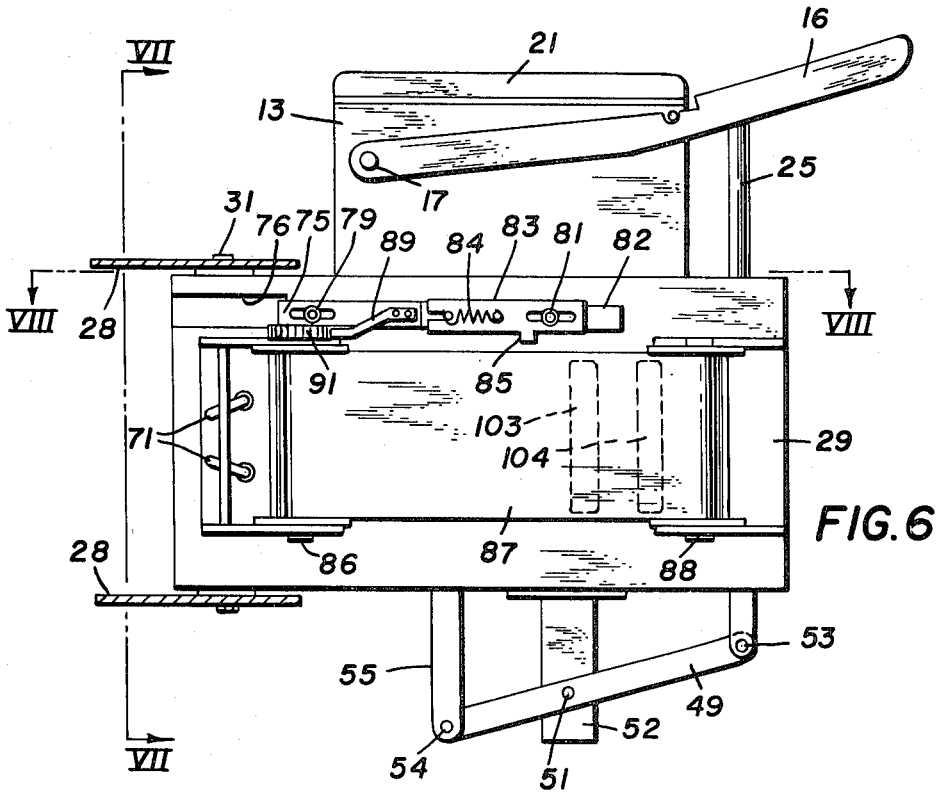
FIG. 6 is a side elevational view of the portion of the recorder.

FIG. 6 shows the inner side of the stamp portion 29. Only a small portion of the time portion 28 is shown along with the hinge shaft 31. This view shows how the ends of the spring 71 extend through suitable apertures in a back wall of the frame and engage the shaft 78. This view shows how the finger 75 protrudes through the opening 76 and extends along the inner surface of the frame. It is provided with slots which ride along pins 79 and 81 so that it is capable of horizontal sliding movement. The finger 75 is, therefore, connected to an elongated bar 82 and, on this bar is slidably mounted another bar 83 which is similarly provided with an elongated slot slidable on the pin 81 at one end and at its other end it is connected by a spring 84 to a pin extending from the front of the bar 82 and slidable in a suitable slot in the bar 83. In other words, the bar 83 not only slides horizontally with the bar 82 but also is capable of independent sliding against the tension of the spring 84. Finally, from the lower end of the bar 83 extends a finger 85 whose purpose will be explained more fully hereinafter. Mounted in the stamp portion 29 is a vertical shaft 86 around which is wound a printing ribbon 87. The other end of the ribbon 87 is wound around a shaft 88 which is also vertically mounted in the stamp portion 29 at the forward end thereof. Extending from the bar 82 is a pawl 89 engaging a ratchet 91 mounted at the top of the shaft 86 to cause winding of the ribbon 87 from the shaft 88 to the shaft 86.

Figure 7:
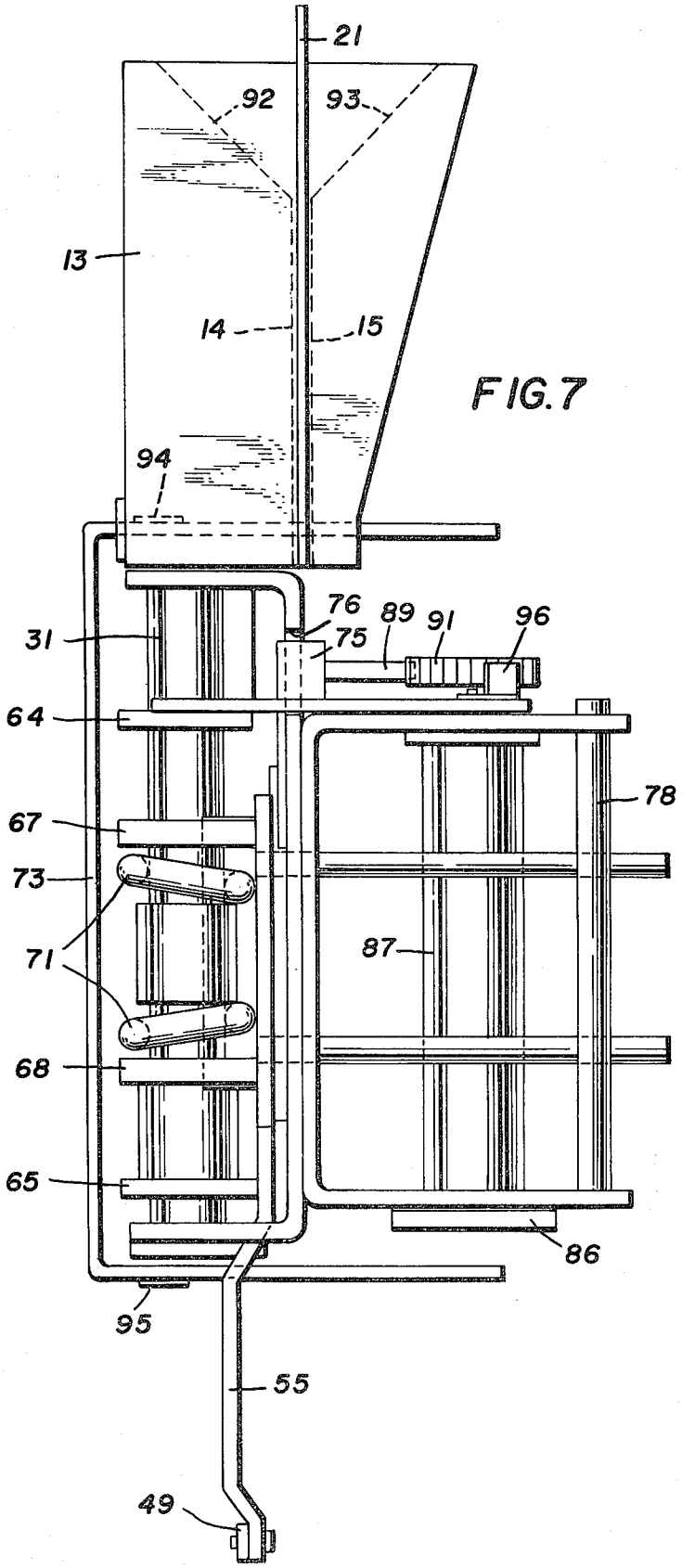
FIG. 7 is an end view of the portion of the recorder taken on the line VII—VII of FIG. 6.

Referring now to FIG. 7, it can be particularly seen here that the slots 14 and 15 are provided with sloping surfaces 92 and 93, respectively, which assist in leading a time card downwardly into the narrow slot. It can be seen in this view how the divider wall 21 serves to define the two slots leading down through the entrance abutment 13 into the interior of the mechanism. This figure of the drawings shows the rivets 94 and 95 by which the latching bar 73 is pivotally attached to the frame. The finger 75 is shown folded around the wall through the opening 76 and the pawl 89 is shown engaging the ratchet 91. A small locking pawl 96 formed of sheet metal is shown engaging the ratchet 91 also.

Figure 8:
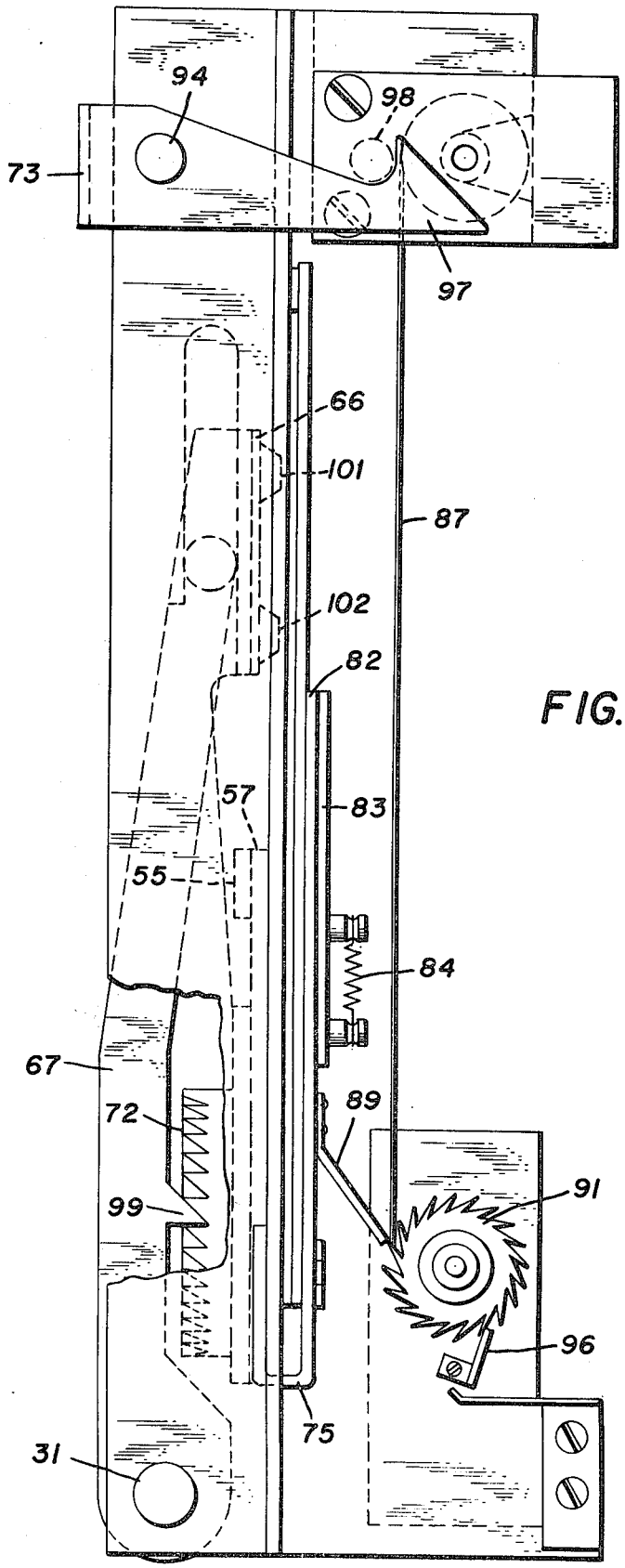
FIG. 8 is a horizontal sectional view of the invention taken on the line VIII—VIII of FIG. 6.

FIG. 8 shows the manner in which the latching bar 73 is provided with a barbed end 97 which engages a post 98 provided on the time portion 28. It can be seen that the leg 67 is provided with a tooth 99 which is adapted to fall into the notches or cams in the cam row 72. It can also be seen that the hammer plate 66 is provided with striking pads 101 and 102 which operate through slots formed in the back wall of the frame, the slots being indicted in dotted lines in FIG. 6 and given the reference numerals 103 and 104.

Figure 9:
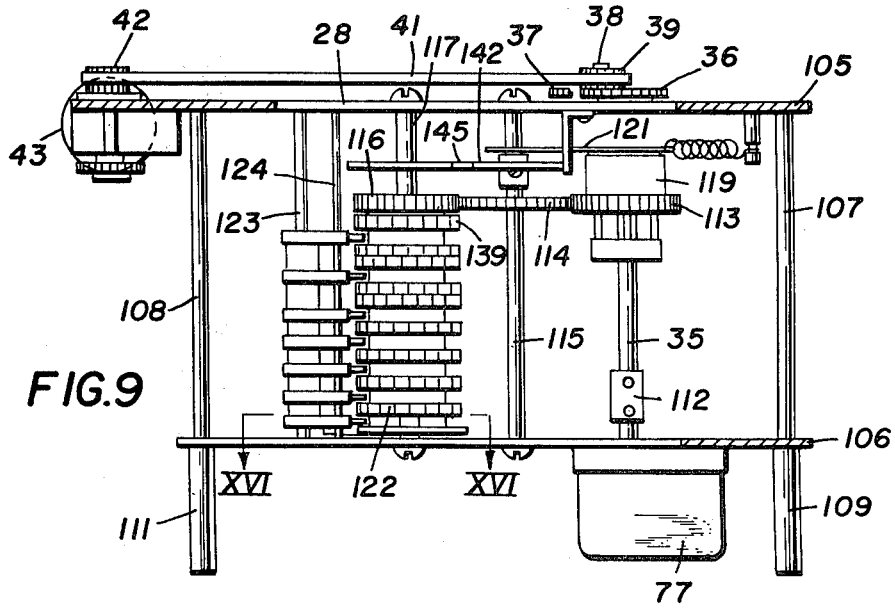
FIG. 9 is a side elevational view of another portion of the recorder.
Figure 10:
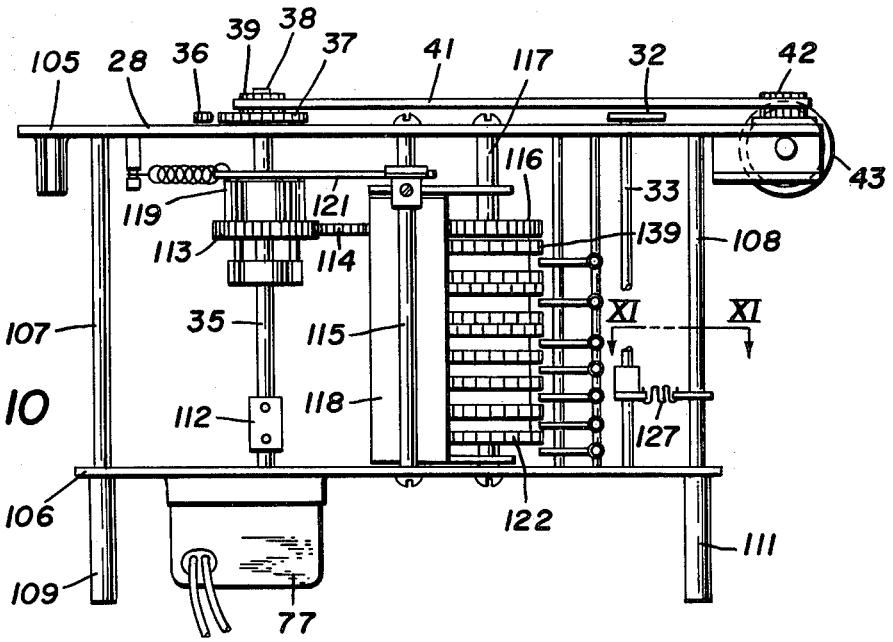
FIG. 10 is another side elevational view of a portion of the recorder.

FIGS. 9 and 10 show the inner and outer side views, respectively, of the time portion 28 of the recorder. The structure is made up of an upper and a lower plate 105 and 106 held in spaced parallel relationship by posts 107 and 108. Legs 109 and 111 extend downwardly from the plate 106 and combine with the extension 52 on the stamp portion 29 to support the recorder on a flat surface when necessary. The output shaft of the motor 77 is connected through a coupling 112 to the shaft 35 which, as has been described in connection with FIG. 4, is provided with a gear 36 where it extends above the plate 105. This gear operates through the gear 37 on the shaft 38 through the gear 39 and the timing belt 41 to drive the gear 42 and, therefore, the time clock wheels 43. The rotation of the shaft 35 also causes rotation of a gear 113 which drives a gear 114 mounted on a vertical shaft 115. This, in turn, drives a gear 116 mounted on a shaft 117. A pawl plate 118 is swingably mounted on the shaft 117 and is reciprocated by a cam 119 mounted on the shaft 35. A cam follower 121 transfers the cam motion to the plate 118. This cam plate operates a series of pawls which, in turn, operate various wheels rotatably mounted on the shaft 106; these elements constitute a time stamp 122 of the type shown and described in the United States patent of Deane et al U.S. Pat. No. 2,355,514 which issued on Aug. 8, 1944. Basically, what happens is that the reciprocatory swinging motion of the plate 118 causes pawls to engage ratchets associated with the time wheels and to move them in such a way that suitable timing characters appear in a vertical line. Associated with the time stamp 122 is a shaft 123 carrying locking pawls and a locking bar 124.

Figure 11:
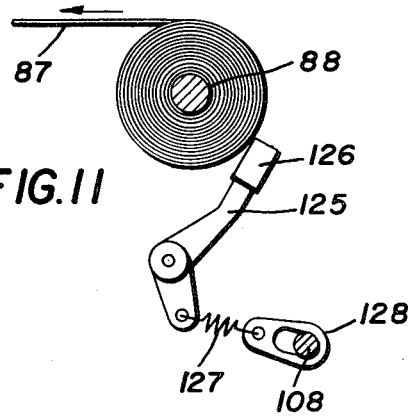
FIG. 11 is a sectional view of the invention taken on the line XI—XI of FIG. 10.

As can be seen from an examination of FIGS. 10 and 11, the indicator 32 mounted on the shaft 33 is rotatable with that shaft. In the lower part of the shaft is carried a bellcrank 125 having one arm provided with a plastic protective sleeve 126 which engages the rolled up portion of a ribbon 87 on the shaft 88 of the stamp portion 29. The other arm of the bellcrank is connected by a coil spring 127 to a ring 128 surrounding the shaft 108.

Figure 12:
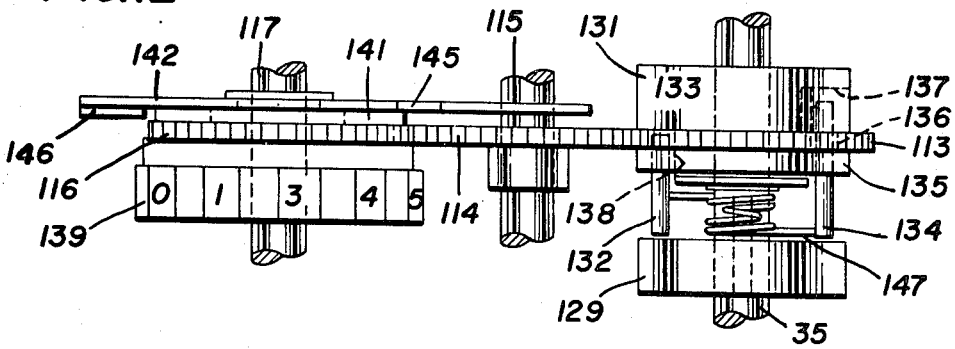
FIG. 12 is an elevational view of a portion of the recorder.

In FIG. 12, it can be seen that the shaft 35 and the gear 113 are connected by an unusual lost motion device. Two spaced parallel collars 129 and 131 are keyed to the shaft 35, while the gear 113 is free to rotate on it. A peg 132 is fixed to the gear 113 and extends vertically upwardly into a peripheral slot 133 (see FIG. 13) formed in the gear 113. A similar peg 134 is fixed to a washer 135 which is also rotatably mounted on the shaft 35 and underlies the gear 113, and this peg 134 extends vertically upwardly and downwardly from the washer 135. It extends upwardly through a slot 136 formed in the gear 113 and into a notch 137 formed on the periphery of the collar 131. The washer 135, incidentally, is also formed with a notch 138 through which the pin 132 extends to terminate close to the collar 129.

Figure 13:
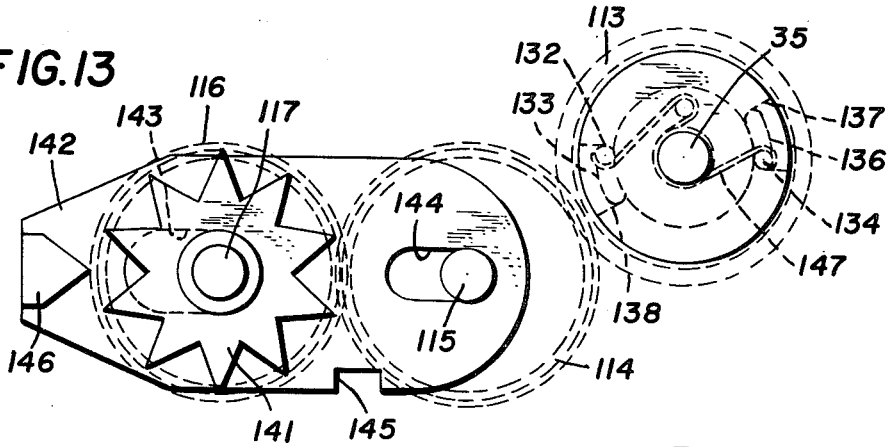
FIGS. 13, 14, and 15 are horizontal views of the portion of the recorder shown in FIG. 12 illustrating the method of operation.
Figure 14:
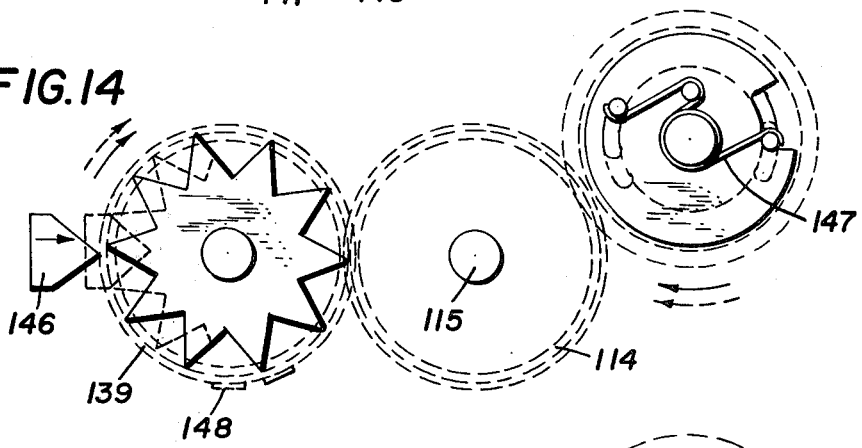

In FIG. 13 it can be seen that the gear 116, which is integral with the seconds wheel 139, is provided with a star wheel 141. Resting on this star wheel and on the gear 114 associated with the shaft 115 is a plate 142. This plate is provided with elongated apertures 143 and 144 through which the shafts 117 and 115, respectively, extend. These apertures are elongated to allow motion of the plate in a horizontal plane in a direction of a line joining the shafts 117 and 115. The forward edge of the plate 142 is provided with a notch 145 (see FIG. 9) which is adapted to engage the finger 85 on the bar 83 (see FIG. 6) when the time portion 28 and the stamp portion 29 are in closed locked condition. To the underside of the plate 142 is attached a pointed cam 146 which is adapted to engage the star wheel 149 when the plate 142 is moved to the right in FIG. 14. This is for the purpose of aligning the characters on the seconds wheel 139 so that they are exactly in line with the corresponding characters in the time stamp 122. Finally, surrounding the shaft 35 is a spring 147 which is coiled around the shaft and has one arm which engages the pin 134 to thrust it in one direction and another arm which engages the pin 132 to thrust it in the other direction. In the position of "REST", the spring 147 presses the pin 134 to the far side of the notch 137 in the collar 131 and to the far side of the notch 138 in the washer 135. The pin 134 is fixed to the washer 135, extends through the slot 136 in the gear 113 into the notch 137 in the collar 131. Its lower end also resides adjacent the collar 129. As can be seen in FIG. 14, when the operator presses the handle 16 to stamp a time card, the cam 146 engages the teeth on the star wheel 141 and this aligns a character 148 with the rest of the characters on the time stamp 122 for the stamping operation. When the handle 16 is released, however, the energy stored in the spring 147 drives back in the manner shown in FIG. 15 and returns the star wheel and the seconds wheel 139 to its original condition before the stamping operation started, so that no time is lost. In other words, the mechanism represented by the collar 129, the washer 135, the gear 113, and the collar 131 operating with the spring 147, the pins 132 and 134, and the various notches and slots provide a lost motion device which allows the seconds wheel 139 to be moved in either direction to line up its closest character to the correct position and then will return the seconds wheel to the condition it would have occupied if this compensating motion had not taken place.

Figure 16:
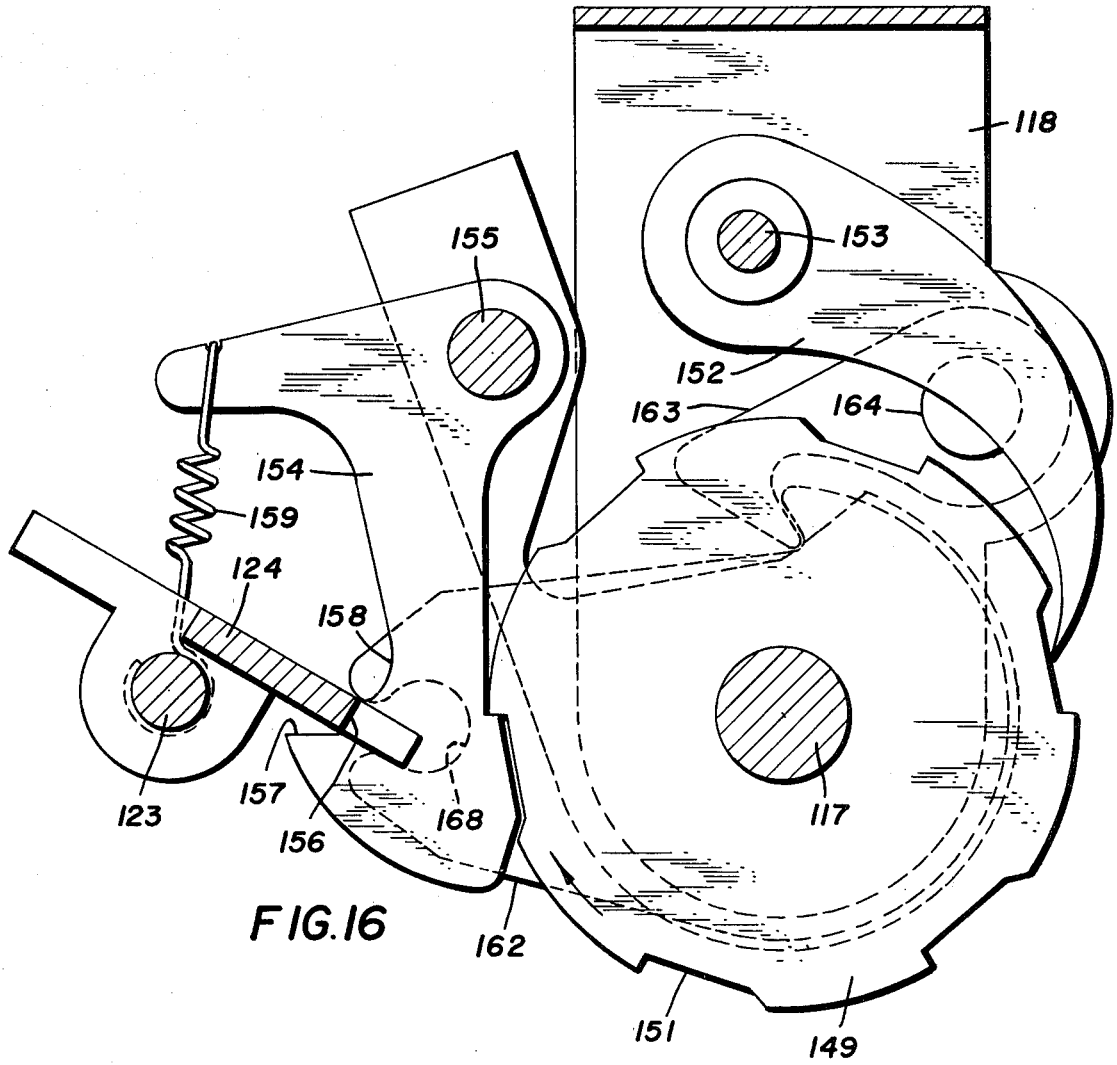
FIG. 16 is an enlarged sectional view of a portion of the recorder taken on the line XVI—XVI of FIG. 9.
Figure 17:
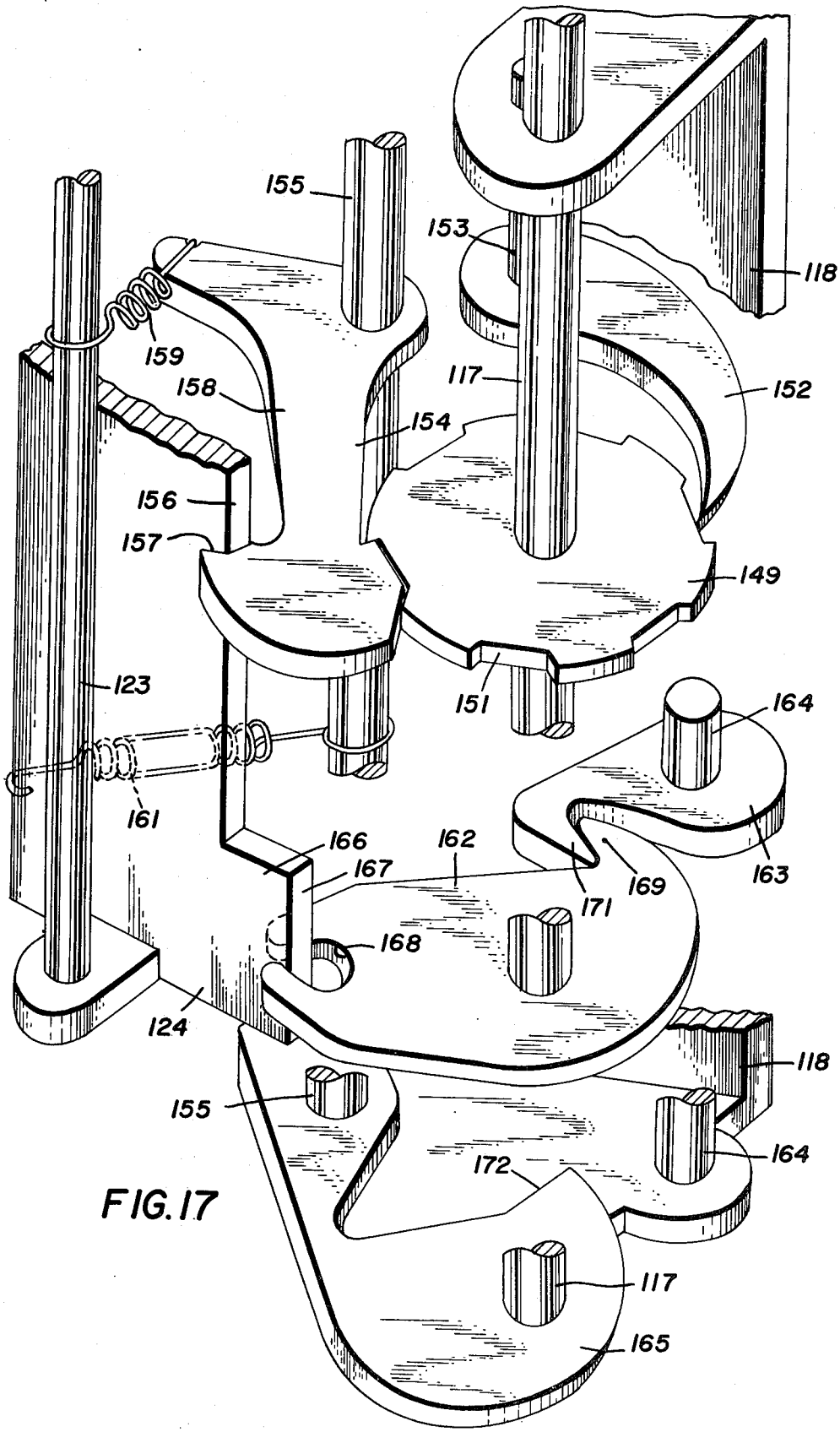
FIG. 17 is an exploded perspective view of the elements shown in FIG. 16.

Referring now to FIGS. 16 and 17, the shaft 117, as has been stated, is provided with time wheels, each of which is provided with an integral ratchet wheel, the time wheels and ratchet wheels being independently rotatable on the shaft 117. A typical ratchet wheel 149 is shown provided with notches 151 whose leading edge is provided with a radial surface and whose trailing edge is inclined to a radial line, which wheel is driven by a pawl 152 having one end pointed to engage the notches 151 and the other end pivotally connected to a shaft 153 which is carried with the pawl plate 118 as it swings about the shaft 117. To prevent the wheel 149 from turning as the pawl 52 is dragged back over its surface on the return swing of the pawl plate 118, there are provided a series of locking pawls 154 rotatably mounted on a shaft 155. It will be noted that its operative portion has a right angle cut to engage the leading edge of the notch 151 and an inclined portion which can engage the inclined trailing surface of the notch 151. Hingedly mounted on the shaft 123 is the lock bar 124 having a vertical edge 156 which engages a right-angled notch 157 formed on the locking pawl 154. Extending from the notch 157, the locking pawl 154 is provided with a curved surface 158. The locking pawl 154 is biased toward the wheel 148 by a spring 159 connecting an arm on the pawl to the shaft 123. In a similar way, the locking bar 124 is rotatably biased in the other direction by a spring 161 connecting a back edge of the bar to the shaft 155. Located beneath the time stamp 122 on the shaft 117 are several elements associated with the locking bar 124. These include a locking bar release element 162 which is rotatably mounted on the shaft 117, a latch 163 which is rotatably mounted on a stub shaft 64 extending upwardly from the bottom of the pawl plate 118, and a cam plate 165 which is fixed to the frame by the fact that the shafts 155 and 117 pass through it. The locking bar 124 is provided with an extension 166 having a vertical edge 167 which lies in a U-shaped notch 168 formed in the release element 162. Almost diametrically opposite this notch 168 the release element 162 is provided with a horn 169 which is engaged on occasion by a hook 171 formed on the latch 163. The latch 163, as is evident in the drawing, is much thicker than the elements 162 so that it subtends not only the thickness of the release element 162 but also that of the cam plate 165, so that the end of its hook 171 rests and slides along an inclined surface 172 formed on the plate 165. This surface has sufficient angularity to the radius extending outwardly from the shaft 117 to cause the hook 171 to feed radially outwardly on occasion to release itself from the horn 169.

The operation of the time recorder 10 will now be readily understood in view of the above description. In order to be operative, the motor 77 must be connected electrically and the timers set by hand so that actual time of day as well as the calendar date appear on the time stamp 122 and the seconds wheel 116. The time of day will appear in the window 112 because of the time wheels 43 showing through the window. When the time recorder is used by a telephone operator to time long distance calls, she fills out her time card with the necessary information including the telephone number of the caller, as well as the telephone number, name, and address of the called station. When the conversation begins, she inserts the time card in the slot 15 and this stamps the date and time that the conversation begins. When it terminates, she inserts the same card in the slot 14 and presses the handle 16 to stamp it with another line indicative of the date and time of termination. These dates and times are stamped in parallel spaced lines on the card.

The operator notes that the white portion of the indicator 32 appears through the aperture 19 in the top of the cover 12 indicating that an adequate supply of ribbon is coiled around the shaft 88. This is because the bellcrank 125 (FIG. 11) resides in a position to follow the roll on the shaft 88 as its diameter decreases. Eventually, as the size of the roll of ribbon decreases, the red part of the indicator appears in the aperture and the operator knows it is time to change ribbons.

When a card has been placed either in the slot 15 or the slot 14, placing the card in the slot 15 means that a certain printing area on the card is lined up with one of the slots 103 and 104 behind which is the pad 101 on the hammer, which is directly lined up with the line of characters on the time stamp 122 and the seconds wheel 139. Placing the card in the slot 14 means that the card is moved toward the front of the machine and the same line appears at a spaced parallel position on the card. The same motor 77 that is driving the time stamp 122 and the seconds wheel 139 is also driving the time clock wheels 43 through the medium of the timing belt 41 and associated gearing.

Referring to FIG. 5, it can be seen that the downward pressure of the handle 15 results in the plunger 25 moving downwardly despite the spring bias from the spring 48. This downward movement of the plunger 25 causes the end of the lever 49 to go down, while causing the end with the pivot pin 54 to go up. This presses the lever 55 upwardly and rotates the plates 57 in a counter-clockwise direction. This has the effect of causing the pawl 59 to engage a ratchet tooth 62 and to rotate the entire ratchet wheel and pawl wheel assembly 72 about the shaft 58. This rotates the row teeth and (referring to FIG. 8) the tooth 99 rides up the inclined back edge of one of the cams causing the arm 67 and its corresponding arm 68 to move away from the back wall of the frame carrying the hammer plate 66 with it. This winds up the spring 71 so that considerable energy is stored. Eventually, the tooth 99 falls over the straight edge of the cam and the hammer is thrown forcibly against the back wall of the frame. The pads 101 and 102 are thus thrust violently through the slots 103 and 104 and they strike the time card against the ribbon 87 and both of them against the time stamp 122 and the seconds wheel 139, thus producing an image on the time card. The leaf spring 72a is very weak compared to the spring 71 and the normal location of the hammer plate 66 is such that the pads 101 and 102 are rearwardly of the back wall of the frame, so that it is possible to withdraw the time card without difficulty after the stroke of the hammer has taken place.

At the same time that the clockwise rotation of the plate 57 operated the hammer plate 66, it also operated by means of the notch 74 and the finger 75 to thrust the finger 75 to the right in FIG. 5. This produced the same right-hand motion of the bar 82 in FIG. 6, which had two effects. First of all, when the bar is returned, the pawl 89 engages the ratchet 91 and causes the shaft 86 to turn incrementally and roll up some of the ribbon 86, thus presenting a new ribbon surface to the stamping area. At the same time, it carried with it the bar 83 in moving to the right, and thus the finger 85 which engages the notch 145 on the plate 142 (see FIG. 14). This causes aligning up of the characters on the seconds wheel 139, as will be described more fully hereinafter.

The plate 57 is returned after the tooth 99 drops into the next valley in the cam row 72 because of the spring 48 urging the plunger 25 into its upward condition. Also, referring to FIG. 6, the spring 84 maintains the tooth 85 and the bar 83 in the right-hand position on the bar 82 but, of course, the bar 82 is maintained to the right-hand position in between striking by the spring 48, as has been described. The motor 77 operates continuously and rotates the shaft 35 continuously in the manner that has been described, irrespective of whether the handle 16 is ever depressed or not. It serves to drive the gear 116 and the seconds wheel 139 continuously while operating through the cam 119 to operate the pawl plate 118 in a reciprocating swinging manner about the shaft 117, thus causing its associated pawls to drive the time stamp 122 in the well-known manner.

Referring to FIGS. 12, 13, 14, and 15, at the time the striking takes place, the finger 85 on the bight 83 engages the notch 145 on the plate 142 and thrusts it to the right. The cam 146 engages the star wheel 141 and centers the star wheel and also places a character 148 in line with the characters on the rest of the time stamp. This is necessary to give a clear image on the time card, so that the time card can be read by optical scanning means. It not only assures that a single character and not parts of two characters is printed, but also that the character is directed directly along the line of stampings so that a clear image is produced. The moving of the star wheel 141 and the seconds wheel 139 also causes backward or forward rotation of the gear 116 which is associated with them. This works back through the gear 114 to rotate the gear 113. At the same time that the gear 113 is being rotated, perhaps in a direction contrary to the normal direction that is driven by the motor 77, the motor continues to drive the shaft 35, so that the pins 132 and 134 operate with the spring 147 to allow for this movement. After the movement has taken place, the spring restores the gear 113 to its former position plus a small time increment and this works back through the gear 114 and the gear 116 to return the seconds wheel 139 to the position that it would have occupied if striking had not taken place. This is due to the fact that the spring 147 acts to center and restore to a given position the collars 131 and 129 as well as the gear 113 and the washer 135.

Figure 15:
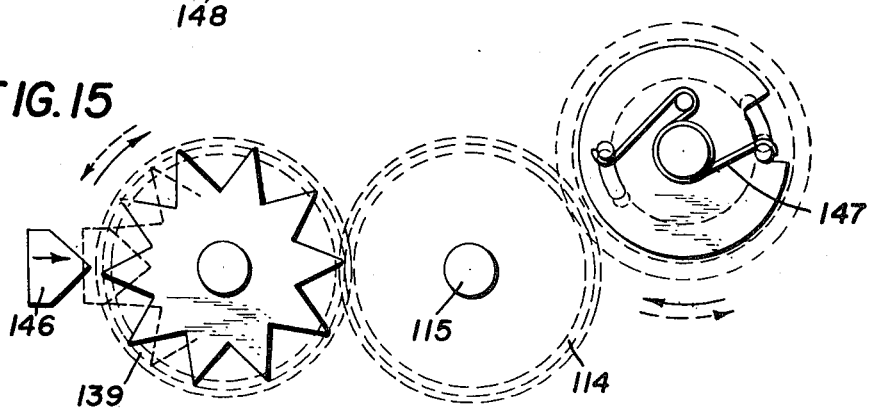

FIG. 14 shows the situation that exists when the cam 146 moves the star wheel in an advanced condition, in which case it is returned backwardly later, while FIG. 15 shows what happens when the cam 146 attracts the star wheel (counterclockwise rotation) and returns it again to its former position.

In FIGS. 16 and 17, is illustrated the manner in which the wheels 149 of the time stamp 122 are locked between thrusts from the pawls 152. It will be understood that, with the type of time stamp used, only one pawl of the series of pawls is actually operating on a wheel at any given time, so that, if all of the locking pawls 154 were released in order to allow the pawls 152 to operate, all but one of the wheels would be loose on the shaft and could vibrate to wrong positions. For that reason, although the locking bar 124 is released from the pawls, nevertheless, it will be understood that only one of the locking pawls 154 will be moving outwardly.

As the pawl plate 118 swings about the shaft 117, it carries the shaft 153 with it, and this carries the pawl 152 in a thrusting position circumferentially of the wheel 149 until it engages a notch and produces an incremental rotation of the wheel 149. Swinging of the pawl plate 118 also carries with it the latch 163 whose hook 171 engages the horn 169 on the release element 162. The release element, therefore, rotates about the shaft 117 and, eventually, swings to a position where the latch bar 124 swings free of the notch 157 and the lock pawl 154. This allows the lock pawl to swing outwardly away from the ratchet wheel 149 and free and slide along the land between the notches 151. This is in synchronization with the movement of the pawl 152 so that, as the pawl engages a notch 151 to rotate the ratchet wheel 149, the locking pawl 154 is allowed to slide up out of the notch in which it resides. As rotation takes place, the lower end of the hook 171 which is sliding along the surface 172 of the cam plate 165 begins to move radially outwardly until it is free of the horn 169. Since the release element 162 is free to rotate about the shaft 117, the spring 161 acts on the locking bar 124 to rotate it back again carrying the element 162 with it. The edge 156 of the locking bar slides along the surface 158 and, eventually, snaps into the notch 157 on the locking pawl and locks it in place so that it can't move until the next cycle. This guarantees that the locking pawl 154 does not sit on a land between notches on the ratchet wheel 149 which would allow the ratchet wheel to move due to vibration and so on. It also prevents plural tooth jumping which takes place under some circumstances. It means that the lock bar 124 prevents the reverse turning of the wheel 149 due to the back drag of the pawl 152 while using only a light spring 159 on the locking pawl 154. If a strong spring were necessary to guarantee that the locking pawl did not operate wrongly, a much larger drive motor would be necessary and the size of the recorder would be much greater. All of this mechanism is, of course, to prevent the characters in the time stamp 122 from moving and it prevents plural teeth jumping and it prevents any locking pawl from ending up on a land between notches. If only one of the pawls 154 did so end up on a land, it would keep the locking bar 124 from locking all of the wheels and they would all be free to rotate until the jammed condition was remedied. The characters would be out of line and the time indicated would be wrong. The present operation prevents this by a positive locking of the locking bar.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A time recorder, comprising:

a. a housing, b. a time stamp shaft mounted in the housing, c. a plurality of time wheels mounted on the shaft, d. an electric motor mounted on the frame and serving to drive a driver shaft, e. a pawl mechanism operated by the motor and operative to index the wheels, f. an additional wheel having a plurality of characters formed on its periphery mounted on the shaft and continuously driven by the motor, and g. means to bring the closest character on the additional wheel to a printing position in alignment with characters on the other wheels, the means consisting of two spaced collars fastened to the driver shaft, a gear and a washer rotatably mounted on the shaft between the collars, a first peg fastened to the gear and extending axially through a notch in the washer, a second peg fastened to the washer and extending through an arcuate slot in the gear into a notch in one of the collars, and a torsion spring coiled around the shaft and having two ends each of which engages a peg to bias the two pegs and their respective gear and washer in different directions of rotation, the means serving to return the additional wheel after printing to the position it would have occupied if printing had not taken place.

2. A time recorder as recited in claim 1, wherein the said means includes a reciprocable plate overlying the said additional wheel and movable at the time of printing, a pointed cam being mounted on the plate for engagement with a star wheel mounted on the additional wheel.

3. A time recorder as recited in claim 2, wherein the motor drives the additional wheel through a gear train that includes the lost-motion means that performs the above-recited function of returning the said additional wheel to its original position.

* * * * *